US010741948B2

(12) United States Patent
Kitagawa

(10) Patent No.: US 10,741,948 B2
(45) Date of Patent: Aug. 11, 2020

(54) CONNECTOR CAPABLE OF SUPPRESSING SOLDER RISING AND FLUX RISING

(71) Applicant: KYOCERA Corporation, Kyoto-shi, Kyoto (JP)

(72) Inventor: Naoki Kitagawa, Yokohama (JP)

(73) Assignee: KYOCERA Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 16/308,820

(22) PCT Filed: May 26, 2017

(86) PCT No.: PCT/JP2017/019758
§ 371 (c)(1),
(2) Date: Dec. 11, 2018

(87) PCT Pub. No.: WO2017/217218
PCT Pub. Date: Dec. 21, 2017

(65) Prior Publication Data

US 2019/0165504 A1 May 30, 2019

(30) Foreign Application Priority Data

Jun. 17, 2016 (JP) ..... 2016-121118

(51) Int. Cl.
*H01R 12/79* (2011.01)
*H01R 12/71* (2011.01)
(Continued)

(52) U.S. Cl.
CPC ..... *H01R 12/716* (2013.01); *H01R 4/028* (2013.01); *H01R 13/03* (2013.01); *H01R 13/405* (2013.01);
(Continued)

(58) Field of Classification Search
CPC ..... H01R 12/79; H01R 12/87; H01R 12/88; H01R 12/59; H01R 12/77; H01R 12/771
(Continued)

(56) References Cited

U.S. PATENT DOCUMENTS 7,637,786 B2 12/2009 Hoshino et al.
8,454,397 B2 6/2013 Nishi et al.
(Continued)

FOREIGN PATENT DOCUMENTS

JP 2004139890 A 5/2004
JP 2008300193 A 12/2008
(Continued)

OTHER PUBLICATIONS

Aug. 22, 2017, International Search Report issued in the International Patent Application No. PCT/JP2017/019758.

*Primary Examiner* — Abdullah A Riyami
*Assistant Examiner* — Justin M Kratt
(74) *Attorney, Agent, or Firm* — Kenja IP Law PC

(57) ABSTRACT

A connector 10 according to the present disclosure comprises a contact 30; and an insulator 20 having an attaching groove 22 on an outer surface into which the contact 30 is inserted and attached, wherein the insulator 20 has a bottom wall 23 formed to be continuous with a bottom surface of the attaching groove 22 in a downward direction; and at least a part of the attaching groove 22 has a wide portion 24 wider in at least one direction than a groove width on the outer surface along a direction parallel to the bottom wall 23.

4 Claims, 7 Drawing Sheets

(51) Int. Cl.

| | |
|---|---|
| ***H01R 13/03*** | (2006.01) |
| ***H01R 4/02*** | (2006.01) |
| ***H01R 13/405*** | (2006.01) |
| ***H01R 13/502*** | (2006.01) |
| *H01R 12/88* | (2011.01) |
| *H01R 12/59* | (2011.01) |
| *H01R 12/77* | (2011.01) |
| *H01R 12/87* | (2011.01) |
| *H01R 12/57* | (2011.01) |

(52) U.S. Cl.
CPC ..... *H01R 13/502* (2013.01); *H01R 12/57* (2013.01); *H01R 12/59* (2013.01); *H01R 12/77* (2013.01); *H01R 12/771* (2013.01); *H01R 12/79* (2013.01); *H01R 12/87* (2013.01); *H01R 12/88* (2013.01)

(58) Field of Classification Search
USPC ..... 439/260, 495, 492
See application file for complete search history.

(56) References Cited

U.S. PATENT DOCUMENTS

| | | | | |
|---|---|---|---|---|
| 2008/0299796 | A1 | 12/2008 | Hoshino et al. | |
| 2011/0287666 | A1* | 11/2011 | Nishi | H01R 4/028 439/660 |
| 2019/0140376 | A1* | 5/2019 | Shirai | H01R 12/585 |

FOREIGN PATENT DOCUMENTS

| | | | | | |
|---|---|---|---|---|---|
| JP | 2009081073 | A | | 4/2009 | |
| JP | 2009152039 | A | | 7/2009 | |
| JP | 2009176426 | A | * | 8/2009 | H01R 12/57 |
| JP | 2009176426 | A | | 8/2009 | |
| JP | 2011029111 | A | | 2/2011 | |
| JP | 2016100253 | A | * | 5/2016 | |
| JP | 2016100253 | A | | 5/2016 | |
| WO | 2011014676 | A1 | | 2/2011 | |
| WO | WO-2014003003 | A1 | * | 1/2014 | H01R 12/714 |

* cited by examiner

CONNECTOR CAPABLE OF SUPPRESSING SOLDER RISING AND FLUX RISING

CROSS-REFERENCE TO RELATED APPLICATION

This application claims priority to and the benefit of Japanese Patent Application No. 2016-121118 filed Jun. 17, 2016, the entire contents of which are incorporated herein by reference.

TECHNICAL FIELD

The present disclosure relates to a connector for electrically connecting circuit boards.

BACKGROUND

Conventionally, connectors for electrically connecting circuit boards through metal contacts attached to an insulator are known. In such connectors, phenomena such as solder rising and flux rising, in which solder and flux used for attaching the contacts to the circuit boards creep up, are known. If the solder and flux creep up the contacts and harden, contact failure between the contacts occurs, resulting in connector product defects. Therefore, several methods for suppressing solder rising and flux rising have been disclosed.

For example, Patent Literature (PTL) 1 discloses a connector for connecting flexible printed circuit boards (FPC). The connector forms a region in which metal plating is not applied and the material surface is exposed on the surface of each contact. Thereby, a region having low wettability with respect to solder and flux is formed in this connector, and thus solder rising and flux rising are suppressed.

PTL 2 discloses a connector for electrically connecting printed circuit boards. In this connector, Ni plating is applied to a part of the surface of each contact. Thereby, a region having low wettability with respect to solder and flux is formed in this connector, and thus solder rising and flux rising are suppressed.

CITATION LIST

Patent Literature

PTL 1: JP 2004-139890 A

PTL 1: JP 2008-300193 A

SUMMARY

A connector according to the presently disclosed embodiment comprises:

a contact; and an insulator having an attaching groove on an outer surface into which said contact is inserted and attached, wherein said insulator has a bottom wall formed to be continuous with a bottom surface of said attaching groove in a downward direction; and at least a part of said attaching groove has a wide portion wider in at least one direction than a groove width on said outer surface along a direction parallel to said bottom wall.

DETAILED DESCRIPTION

Figure 1:
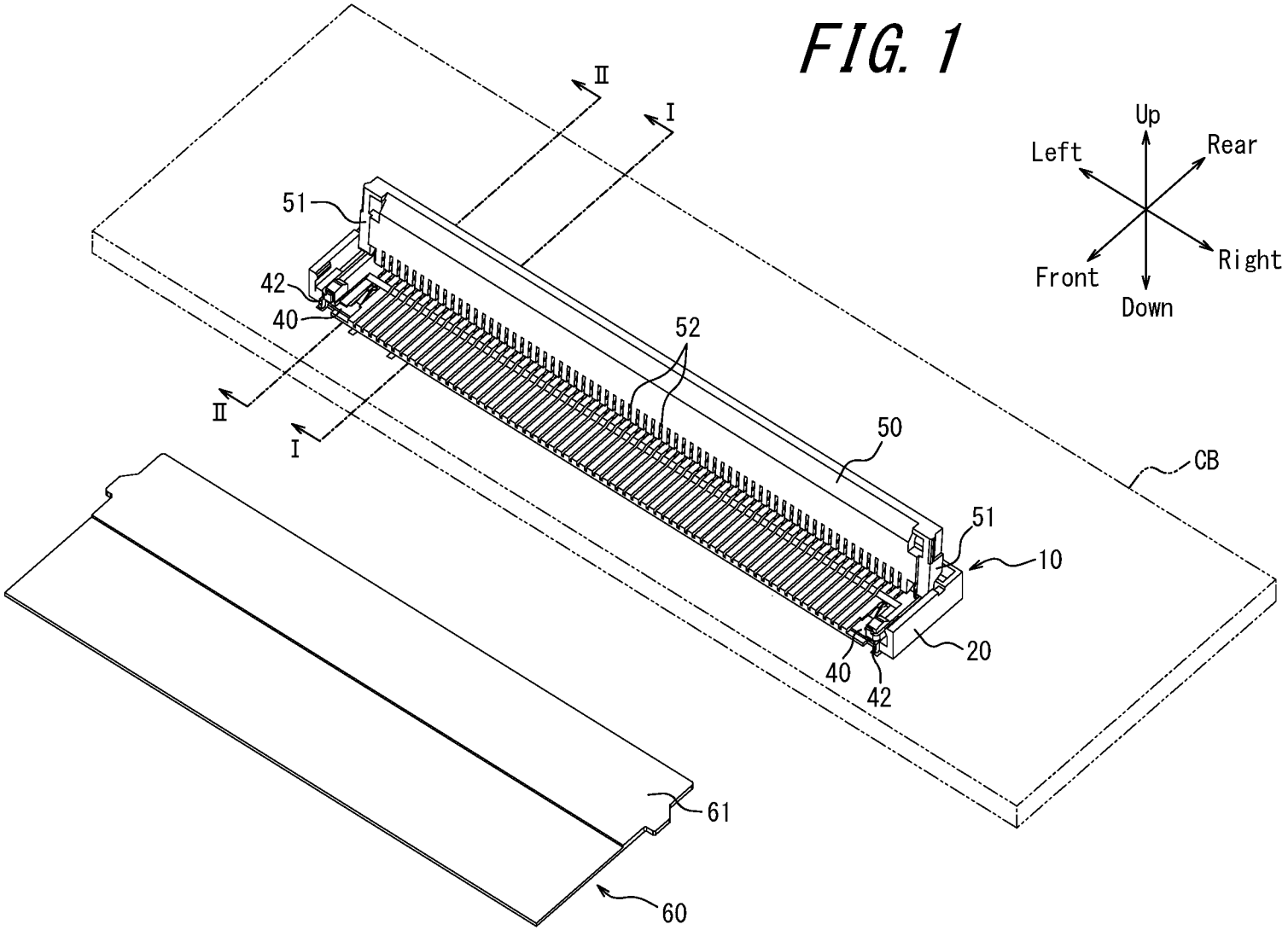
FIG. 1 is a top perspective view illustrating a connector according to an embodiment and an FPC in a separated state.

On another front, since the contacts and the insulator are mounted close to each other, solder rising and flux rising are promoted by capillary phenomenon. A problem exists in that solder rising and flux rising cannot be sufficiently suppressed by merely forming a region having low wettability in a part of each contact in the above manner.

According to the connector of the presently disclosed embodiment, it is possible to suppress solder rising and flux rising.

Hereinafter, an embodiment is described in detail with reference to the accompanying drawings. Note that the directions in the following description, such as front-rear, left-right, and up-down, are based on the directions indicated by the arrows in the drawings.

In the following description, as an example, a connector 10 according to an embodiment is described as one configured to be connected to an FPC 60 (a connection object), which is a flexible printed circuit board; however, the present disclosure is not limited thereto. The connector 10 may be an arbitrary connector, as long as it is configured to electrically connect circuit boards through metal contacts attached to an insulator. The connector 10, for example, may be connected to a flexible flat cable instead of the flexible printed circuit board.

Figure 2:
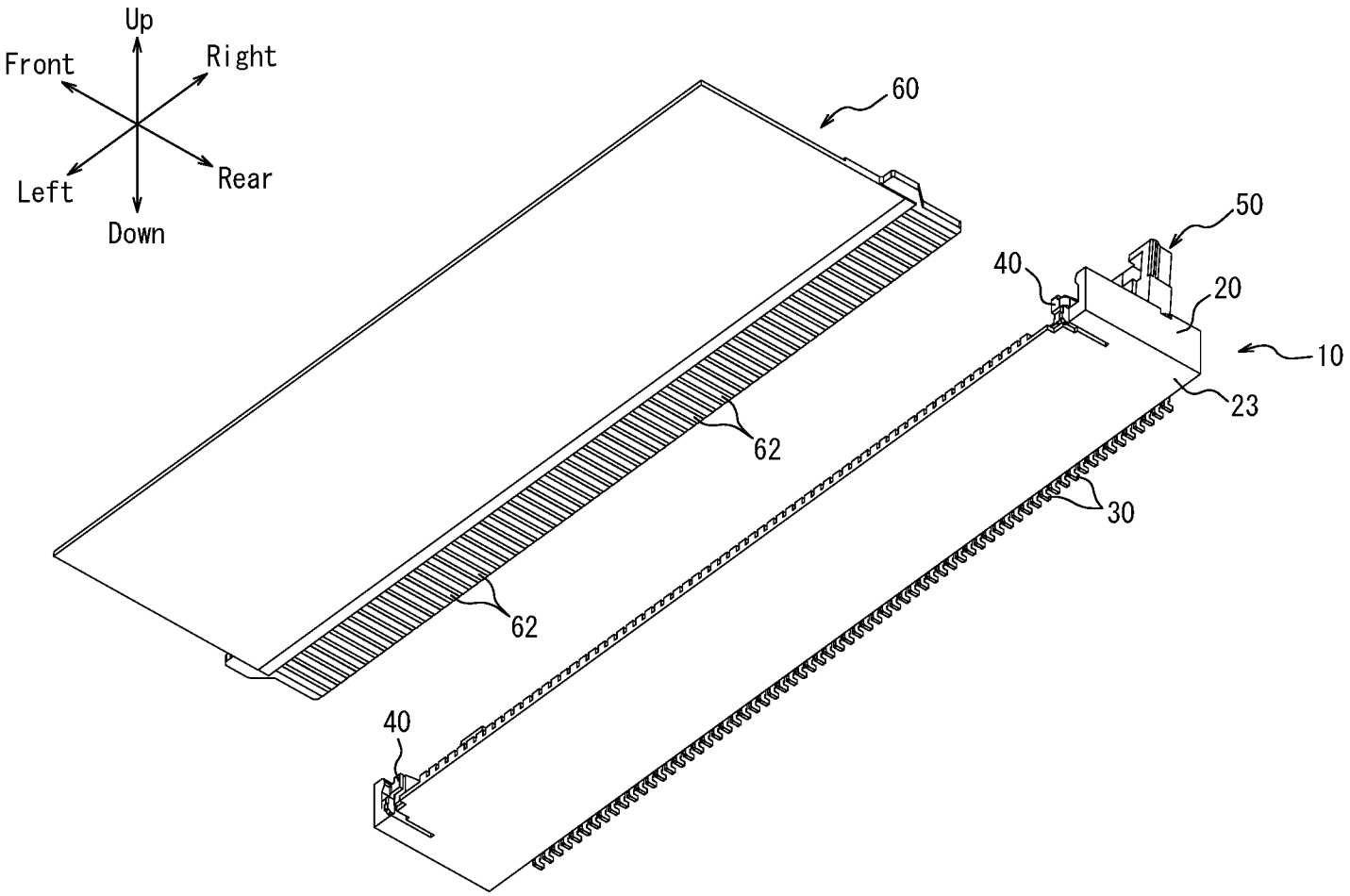
FIG. 2 is a bottom perspective view illustrating the connector and the FPC of FIG. 1 in the separated state.
Figure 3:
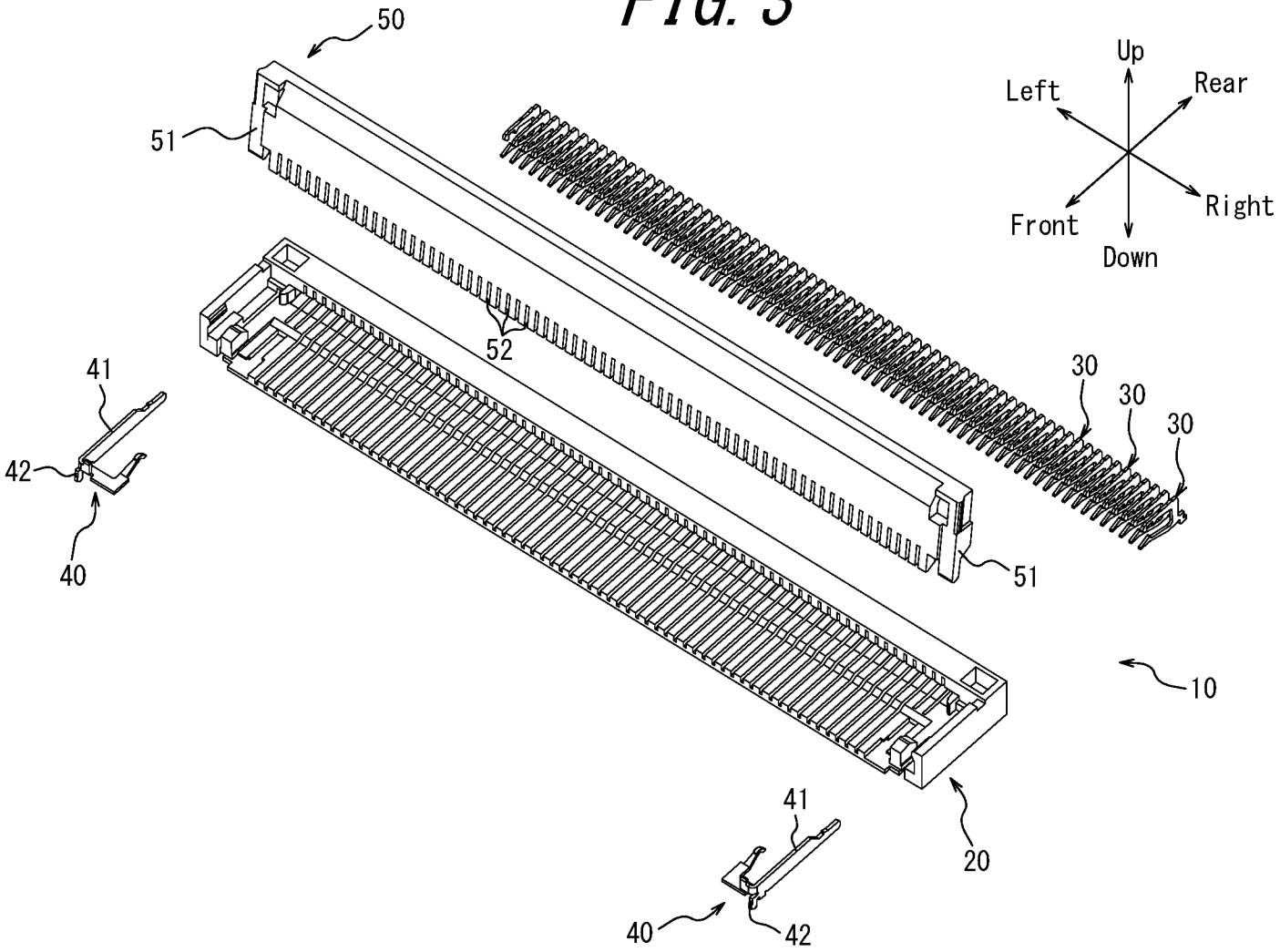
FIG. 3 is an exploded top perspective view illustrating the connector of FIG. 1.
Figure 4:
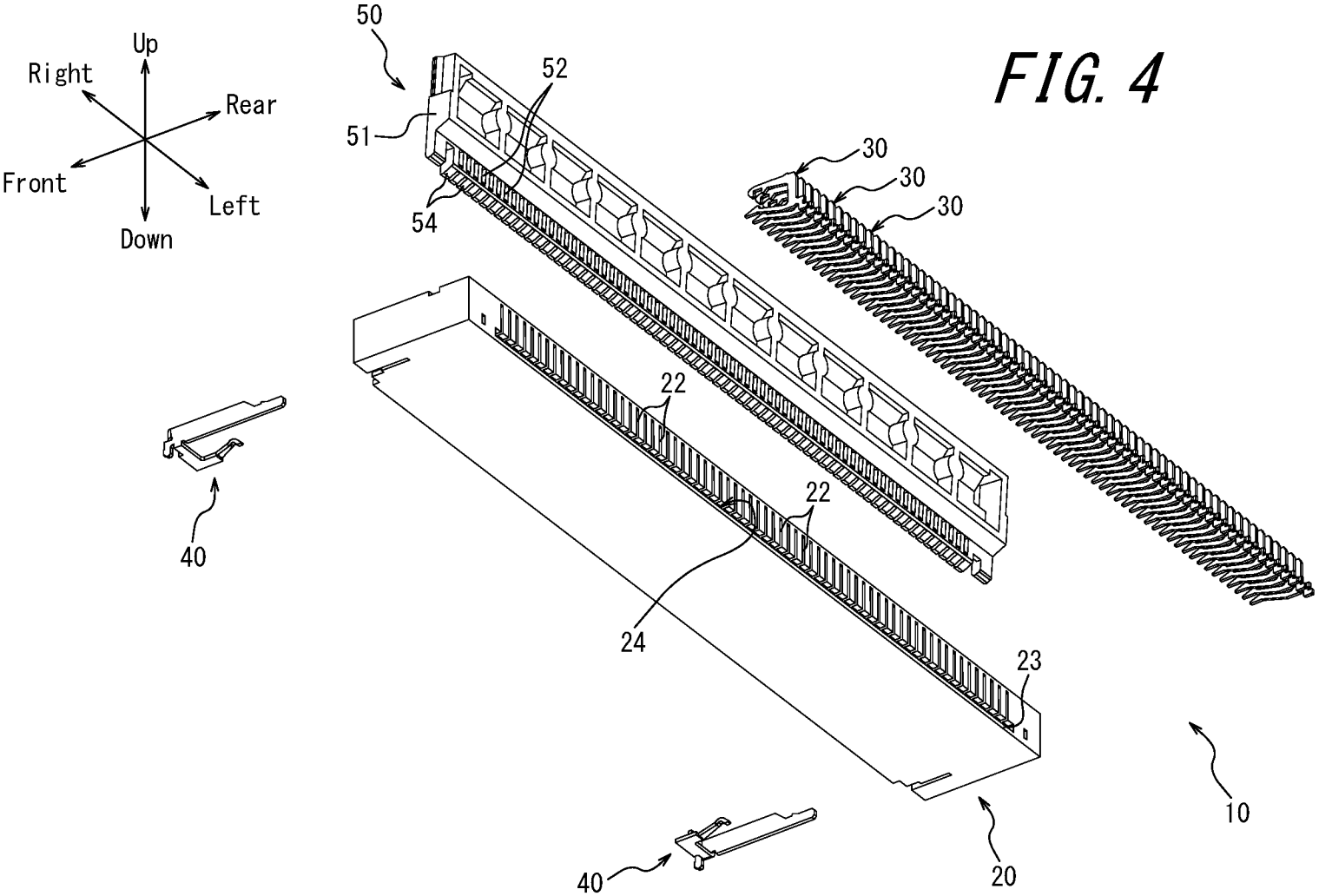
FIG. 4 is an exploded bottom perspective view illustrating the connector of FIG. 1.
Figure 5:
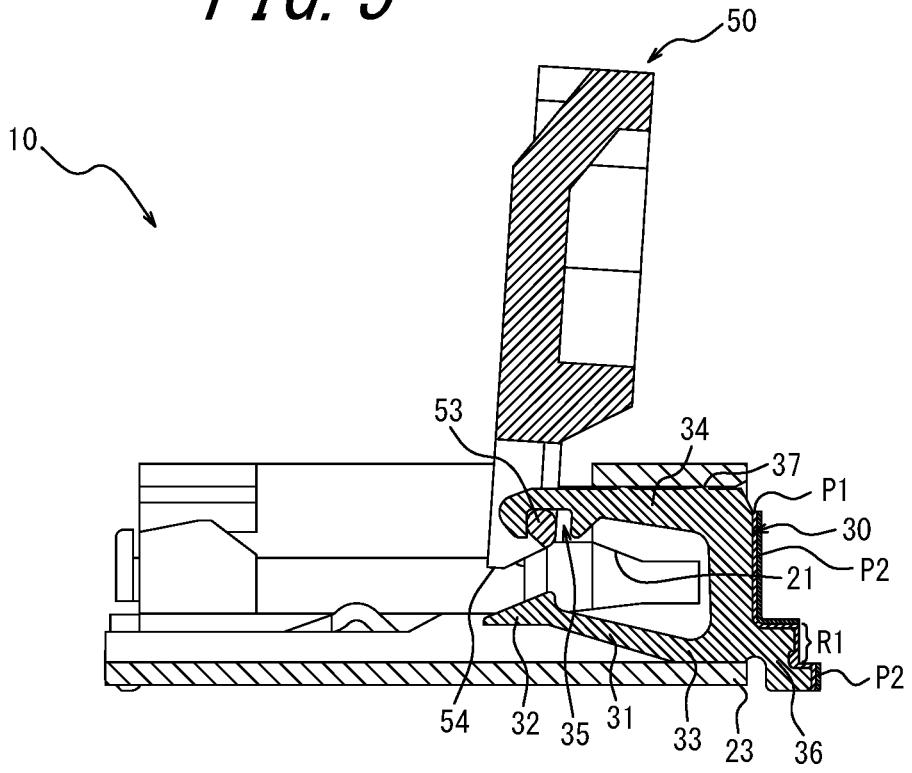
FIG. 5 is a cross-sectional view of the connector taken along line I-I of FIG. 1.
Figure 6:
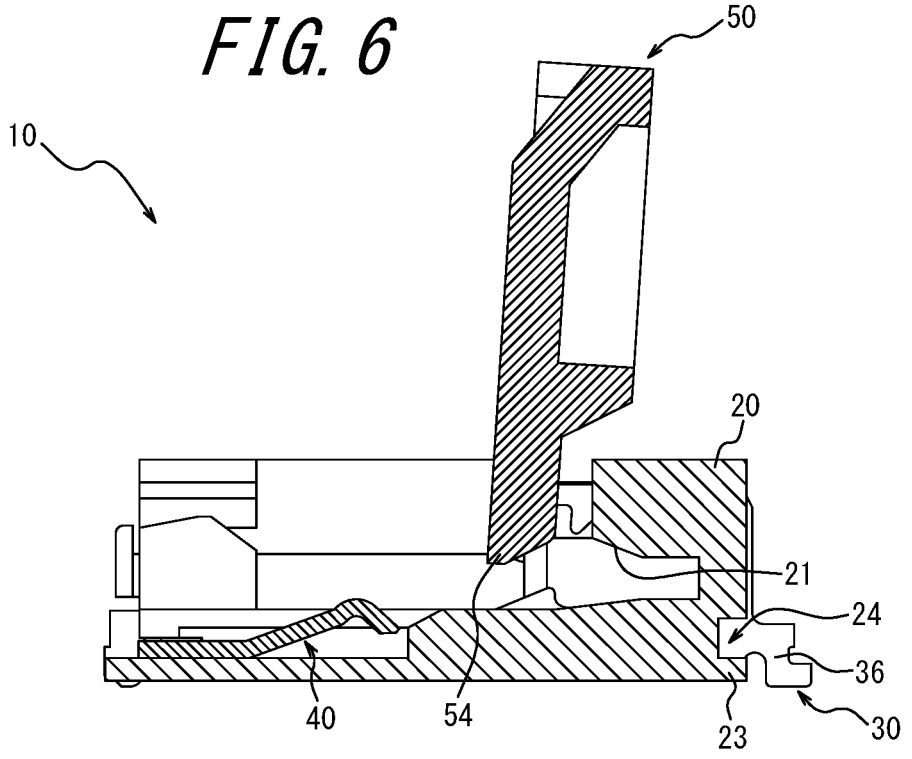
FIG. 6 is a cross-sectional view of the connector taken along line II-II of FIG. 1.
Figure 7:
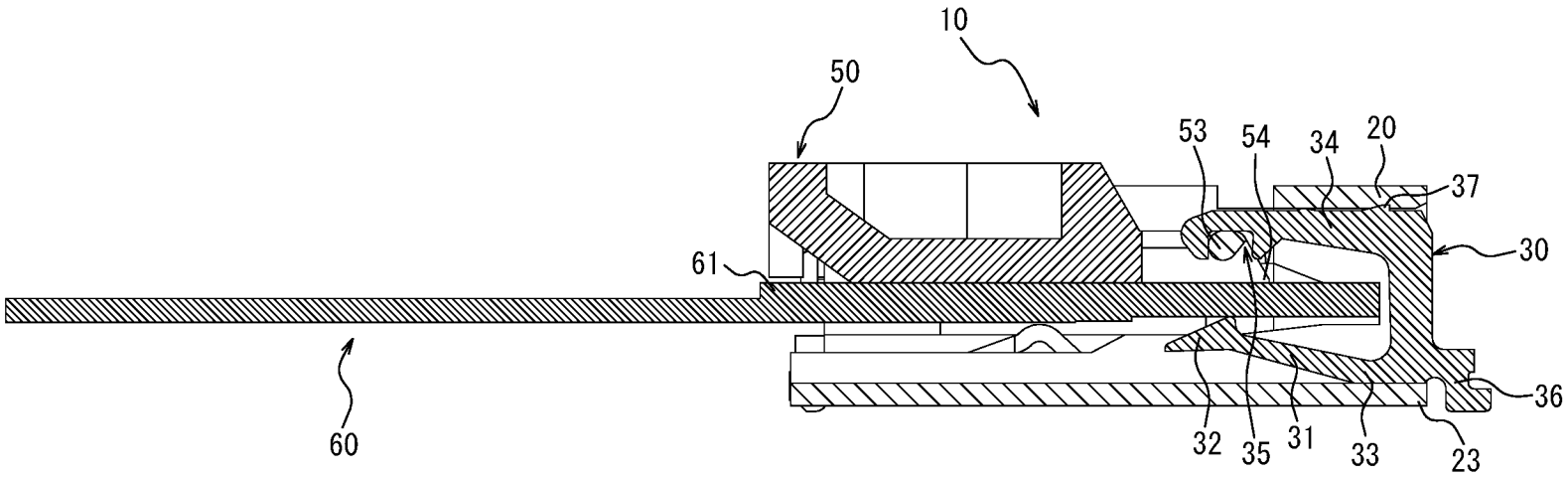
FIG. 7 is a cross-sectional view corresponding to FIG. 5 when the actuator is rotated to the closed position in a state in which the FPC is inserted.

FIG. 1 is a top perspective view illustrating the connector 10 according to the present embodiment and the FPC 60 in a separated state. FIG. 2 is a bottom perspective view illustrating the connector 10 and the FPC 60 of FIG. 1 in a separated state. FIG. 3 is an exploded top perspective view illustrating the connector 10 of FIG. 1. FIG. 4 is an exploded bottom perspective view illustrating the connector 10 of FIG. 1. FIG. 5 is a cross-sectional view of the connector 10 taken along line I-I of FIG. 1. FIG. 6 is a cross-sectional view of the connector 10 taken along line II-II of FIG. 1. FIG. 7 is a cross-sectional view corresponding to FIG. 5 when the actuator 50 is rotated to the closed position in a state in which the FPC 60 is inserted.

As illustrated in FIG. 3, the connector 10 according to the present embodiment includes, as large components, an insulator 20, contacts 30, fixing metal fittings 40, and an actuator 50. As illustrated in FIG. 1, the connector 10 is mounted on a circuit board CB. The connector 10 is configured to electrically connect the FPC 60 and the circuit board CB through the contacts 30.

The insulator 20 is formed by injection molding an insulating and heat-resistant synthetic resin material. In the front portion of the upper surface of the insulator 20, a cable insertion groove 21 is recessed for inserting the FPC 60. The front surface of the cable insertion groove 21 and the upper surface of the front portion thereof are open. The rear portion of the cable insertion groove 21 extends to the inside of the insulator 20 (see FIGS. 5 and 6). In the rear surface of the insulator 20, a plurality of attaching grooves 22 extending in the front-rear direction are formed (see FIG. 4). The plurality of attaching grooves 22 are arranged in the left-right direction spaced apart from each other by a predetermined distance. The bottom surfaces of the plurality of attaching grooves 22 are formed such that, the respective up-down positions are substantially the same. The surface shape of each attaching groove 22 along the rear surface of the insulator 20 is a rectangular shape having the long side in the up-down direction and the short side in the left-right direction. The lengths of the long side and the short side of each attaching groove 22 are respectively slightly larger than the up-down direction width and the left-right direction width of the rear surface of the corresponding contact 30, such that, as will be described later, the contact 30 can be pressed into the attaching groove 22 and fixed. That is, when the contact 30 is fixed inside the attaching groove 22, the inner surface of the attaching groove 22 is in contact with or close to the surface of the contact 30. The rear portion of each attaching groove 22 penetrates the rear portion of the insulator 20 in the front-rear direction. The front portion of each attaching groove 22 is recessed in the bottom surface of the cable insertion groove 21. At the lower end portion of the insulator 20, a bottom wall 23 is formed so as to be continuous with the bottom surfaces of the attaching grooves 22 in the downward direction. That is, when the connector 10 is mounted on the circuit board CB, the bottom wall 23 is located between the bottom surfaces of the attaching grooves 22 and the circuit board CB.

The plurality of contacts 30 are formed into the illustrated shape by molding a copper alloy having spring elasticity (such as phosphor bronze, beryllium copper, titanium copper or the like) or a corson type copper alloy thin plate using a progressive mold (stamping) (see FIG. 5). To the surface of each contact 30, base plating P1 is applied as a base. On a part of the upper surface of the base plating P1, surface layer P2 plating is laminated. The base plating P1 is made of, for example, a material such as nickel, a palladium nickel alloy, copper or the like, and has low wettability with respect to solder and flux. On the other hand, the surface layer P2 plating is made of, for example, a material such as gold, silver, tin, tin copper alloy or the like, and has high wettability to solder and flux. The surface of each contact 30 may be such that, the surface layer P2 plating is partially formed only on the circuit board CB mounting portion and the FPC 60 contact portion, which are important for transmitting electric signals, and the other portions are formed by the base plating P1. The surface of each contact 30 may also be such that, the base plating P1 is formed only in the optimum region, and the other portions are all formed by the surface layer P2 plating, for the purpose of suppressing solder rising and flux rising. In order to effectively suppress solder rising and flux rising, it is necessary that in the optimum region of each contact 30, the base plating P1 is exposed to surfaces in all directions included in this region.

As illustrated in FIGS. 3, 4 and 5, each contact 30 is substantially U-shaped as viewed from a side surface. Each contact 30 includes a contact arm 31 having a contact protrusion 32 at its tip, and an arm supporting portion 33 for supporting the contact arm 31. Each contact 30 further includes a presser arm 34 located directly above the contact arm 31 and having a supporting recessed portion 35 in the bottom surface near the tip, and a tail piece 36 (mounting portion) protruded at the rear end. As will be described below, the tail piece 36 (mounting portion) of each contact 30 is configured to be connected to a circuit pattern on the circuit board CB by soldering.

The respective contacts 30 are supported by the insulator 20 by being attached to the respective attaching grooves 22. More particularly, the respective contacts 30 are pressed into the respective attaching grooves 22 of the insulator 20 from the rear. As illustrated in FIG. 5, when the respective contacts 30 are pressed into the respective attaching grooves 22, the arm supporting portion 33 is supported by the upper surface of the bottom wall 23 of the insulator 20. The contact arm 31 (contact protrusion 32) is located within the cable insertion groove 21. A locking protrusion 37 protruding from the upper surface of the presser arm 34 bites into the upper surface of the corresponding attaching groove 22 (see FIGS. 5 and 7). Thereby, the contact 30 is fixed with respect to the attaching groove 22. As described above, when the contact 30 is fixed with respect to the attaching groove 22, the surface of the contact 30 is in contact with or close to the inner surface of the attaching groove 22. The tail piece 36 protrudes rearward from the rear surface of the insulator 20. The bottom surface of the tail piece 36 is located below the bottom surface of the insulator 20.

The pair of left and right fixing metal fittings 40 are press formed products from a metal plate. The fixing metal fittings 40 are attached to the left and right ends of the insulator 20 (see FIG. 3). On the upper surface of each fixing metal fitting 40, a supporting surface 41 consisting of a horizontal plane is formed. At the front end portion of each fixing metal fitting 40, a downward tail piece 42 is protruded. The fixing metal fittings 40 are fixed to the insulator 20 by being pressed into the insulator 20 from the front.

The rotary actuator 50, which is a plate-like member extending in the left-right direction, is formed by injection molding a heat-resistance synthetic resin material using a metal mold. On both the left and right side portions thereof, a side arm 51 is provided. In the vicinity of the lower end portion of the actuator 50, a plurality of arm insertion through-holes 52 penetrating the actuator 50 in the plate thickness direction are formed side by side in the left-right direction. Directly under each arm insertion through-hole 52, a rotation center axis 53 is formed to close the lower end of the arm insertion through-holes 52 (see FIG. 5). At the lower end portions of the parts located between the adjacent arm insertion through-holes 52, a plurality of cam portions 54 are provided (see FIGS. 4 and 6).

By engaging the supporting recessed portion 35 with the rotation center axis 53 while inserting the presser arm 34 of the corresponding contact 30 into each arm insertion through-hole in a state substantially perpendicular to the insulator 20 as illustrated in FIGS. 1 and 3 (see FIG. 5), and placing the base end portions of the left and right side arms 51 on the supporting surfaces 41 of the left and right fixing metal fittings 40, the actuator 50 is supported by the contacts 30 and the fixing metal fittings 40.

In this manner, the base portions of the side arms 51 are supported by the supporting surfaces 41, and thus the engagement relationship between the supporting recessed portion 35 of each contact 30 and the corresponding rotation center axis 53 is maintained. Therefore, the actuator 50 is rotatable around the rotation center axis 53 with respect to the insulator 20 (the insertion/removal direction of the FPC 60).

The connector 10 can be mounted on the upper surface (circuit formation surface) of the circuit board CB (see the virtual line in FIG. 1) that is substantially parallel to the front-rear direction. More particularly, the tail piece 36 of each contact 30 is placed on a solder paste applied to a circuit pattern (not illustrated) on the circuit board CB, and the tail piece 42 of each of the left and right fixing metal fittings 40 is placed on a solder paste applied to a grounding pattern (not illustrated) on the circuit board CB. Then, each solder paste is heated and melted in a reflow furnace or the like, and thereby each tail piece 36 is soldered to the aforementioned circuit pattern, and each tail piece 42 is soldered to the aforementioned grounding pattern. In this way, the connector 10 is mounted on the circuit board CB.

As illustrated in FIGS. 1 and 2, the FPC 60 has a laminated structure in which a plurality of thin film materials are bonded to each other. The FPC 60 includes an end portion reinforcing member 61 constituting both end portions in the longitudinal direction and is harder than the other portions, and a plurality of circuit patterns 62 extending linearly along the extension direction of the FPC 60 and extending to the bottom surface of the end portion reinforcing member 61.

For connection with the FPC 60 (connection object), the actuator 50 is rotated to the open position. After the actuator 50 is rotated to the open position, the rear end portion of the FPC 60 is inserted into the cable insertion groove 21 from the forward-diagonally upward side. Then, by rotating the actuator 50 forward to the closed position, the surface on the fixing metal fitting 40 side of each side arm 51 is brought into contact with the corresponding supporting surface 41. Each cam portion 54 of the actuator 50 comes into surface contact with the upper surface of the FPC 60, and the FPC 60 is pressed downward. Accordingly, the respective circuit patterns 62 of the FPC 60 come into reliable contact with the respective contact protrusions 32 while elastically deforming the respective contact arms 31 of the contacts 30 downward (see FIG. 7).

Figure 8:
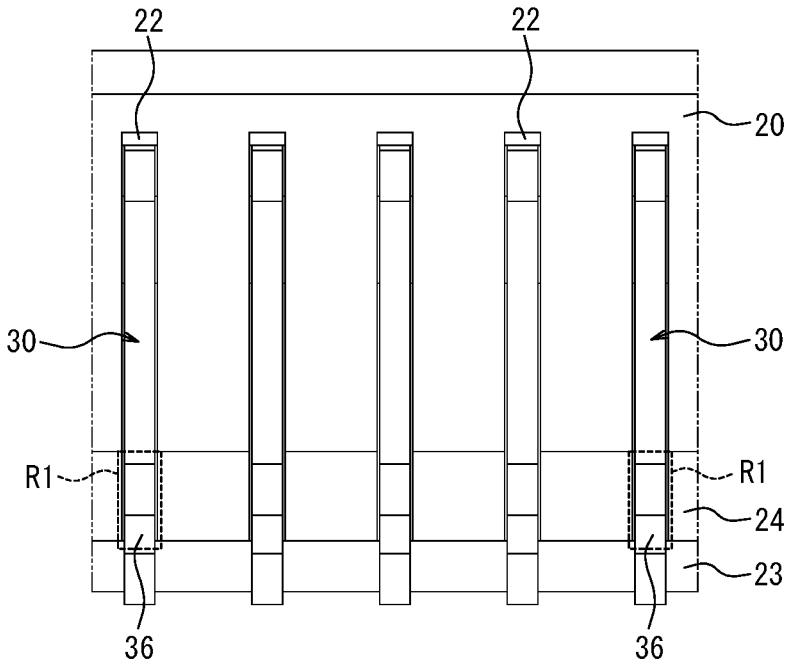
FIG. 8 is an enlarged view in which a part of the rear surface of the insulator is enlarged.

The structure of the rear surface of the insulator 20 in which the plurality of attaching grooves 22 are formed is described more particularly. FIG. 8 is an enlarged view in which a part of the rear surface of the insulator 20 is enlarged.

In the rear surface (outer surface) of the insulator 20, a wide portion 24 is formed further in the upward direction than the bottom wall 23. The wide portion 24 is formed in at least a part of the attaching grooves 22 so as to be wider in at least one direction than the groove width on the rear surface along the left-right direction (direction parallel to the bottom wall 23). In FIGS. 4 and 8, as an example, the wide portion 24 is formed to a continuous recessed portion, extending from the left peripheral edge portion of the attaching groove 22 located at the leftmost end to the right peripheral edge portion of the attaching groove 22 located at the rightmost end among the plurality of attaching grooves 22 formed in the rear surface of the insulator 20. The bottom surface of the wide portion 24 is such that, the position thereof in the up-down direction (direction perpendicular to the bottom wall 23) is substantially the same as that of the bottom surface of the attaching grooves 22. That is, the wide portion 24 is formed on the bottom wall 23 such that, the upper surface of the bottom wall 23 coincides with the bottom surface of the wide portion 24. As illustrated in FIG. 5 or 6, the upper surface of the wide portion 24 is located above the arm supporting portion 33. In FIG. 6, as an example, the up-down direction position of the upper surface of the wide portion 24 substantially coincides with the up-down direction position of the upper surface of the tail piece 36. As described above, the wide portion 24 is formed in the rear surface of the insulator 20 with a rectangular shape having the long side in the left-right direction and the short side in the up-down direction as a whole (see FIG. 4).

Each contact 30, as described above, has a region R1 in which the base plating P1 is exposed, for the purpose of suppressing solder rising and flux rising. It is preferable that at least a part of the region R1 in which the base plating P1 is exposed of each contact 30 is located within the width of the wide portion 24 along the direction perpendicular to the bottom wall 23, namely, the up-down direction. In the connector 10 according to the present embodiment, as an example, the region R1 is a region extending over the outer surface of a part of the tail piece 36 illustrated in FIGS. 5 and 8. That is, in the region R1, the outer surfaces in all the directions, including the rear surface of the tail piece 36 illustrated in FIG. 8, one side surface of the tail piece 36 illustrated in FIG. 5, the other side surface of the tail piece 36, and the upper surface and bottom surface of the portion corresponding to the region R1 of the tail piece 36, are formed by the base plating P1.

The connector 10 according to the above-described embodiment is capable of suppressing solder rising and flux rising, particularly solder rising and flux rising due to capillary phenomenon, by the wide portion 24 formed in the rear surface of the insulator 20. That is, by forming the wide portion 24 in at least a part of the attaching grooves 22, the inner surfaces of the attaching grooves 22, which were close to the surfaces of the contacts 30, are removed in this part. As a result, a larger gap is formed between the surfaces of the contacts 30 and the inner surface of the insulator 20, and thus capillary phenomenon is suppressed.

By forming a region R1 in which the base plating P1 having low wettability with respect to solder and flux on the outer surface of each contact 30, it is possible for the connector 10 to suppress conventional solder rising and flux rising.

Due to the synergistic effect of the two configurations, that is, the formation of the wide portion 24 and the exposure of the base plating P1 in the corresponding regions R1, it is possible for the connector 10 according to the present embodiment to further suppress solder rising and flux rising in comparison with conventional connectors. As a result, the connector 10 is capable of preventing the contact arms 31 from hardening due to solder rising and flux rising, and thus suppressing a change in the elastic modulus of the contact arms 31. That is, the connector 10 can bring the contacts 30 into reliable contact with the circuit patterns 62 of the FPC 60, and can prevent connector product failure such as contact failure. As described above, even if the connector is, for example, an arbitrary connector having a reduced height, the contact stability with the connection object can be maintained. Similarly, the connector 10 is capable of preventing solder and flux from hardening in the engagement portions of the supporting recessed portions 35 and the rotation center axis 53 due to solder rising and flux rising. That is, the connector 10 enables stable opening and closing operations of the actuator 50.

In the connector 10, since the up-down direction position of the bottom surface of the wide portion 24 is substantially the same as that of the bottom surface of each attaching groove 22, solder rising and flux rising can be suppressed at the lower end portion of each attaching groove 22. That is, in the connector 10, solder rising and flux rising can be more stably suppressed, leading to an improvement in stability when mounting the connector 10 on the circuit board CB.

In the connector 10, by placing the upper surface of the wide portion 24 above the arm supporting portions 33, solder rising and flux rising can be suppressed further effectively. That is, in the connector 10, by making the up-down direction width of the wide portion 24 larger than that of each arm supporting portion 33, regions in which capillary phenomenon occurs are reduced, and thus solder rising and flux rising due to capillary phenomenon can be suppressed further effectively.

It would be apparent to those skilled in the art that the present disclosure can be realized in predetermined forms other than the above described embodiment, without departing from the spirit or essential features thereof. Therefore, it should be understood that the above description is an example, and does not restrict the present disclosure. The scope of the disclosure is defined by the appended claims rather than by the above description. Among any changes, several changes within the equivalent scope shall be included therein.

Figure 9:
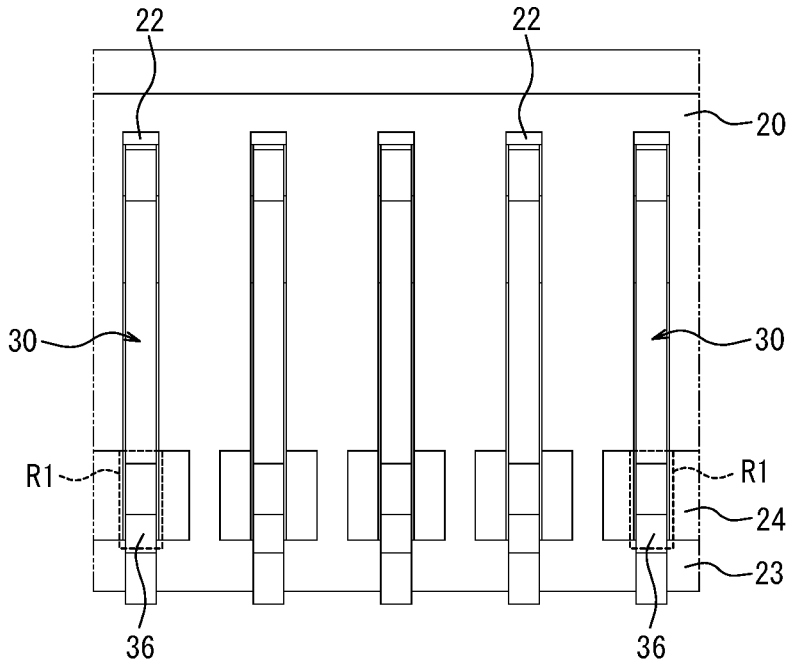
FIG. 9 is an enlarged view corresponding to FIG. 8, in which a part of the rear surface of an insulator according to a variation is enlarged.

FIG. 9 is an enlarged view corresponding to FIG. 8, in which a part of the rear surface of an insulator 20 according to a variation is enlarged. As illustrated in FIG. 4, it has been described that the wide portion 24 is continuously formed from the left end to the right end in the rear surface of the insulator 20; however, the present disclosure is not limited thereto. The wide portion 24 may be formed into any shape, as long as it is formed in at least a part of the attaching grooves 22 and capillary phenomenon can be suppressed.

For example, in FIG. 9, a wide portion 24 is formed for each attaching groove 22. The respective wide portions 24 formed in the respective adjacent attaching grooves 22 are spaced apart from each other at predetermined intervals in the left-right direction. On the other hand, the up-down direction position of the bottom surface of each wide portion 24 is substantially the same as that of the bottom surface of each attaching groove 22. That is, each wide portion 24 is formed on the bottom wall 23, such that the upper surface of the bottom wall 23 coincides with the bottom surface of the wide portion 24. In this manner, each wide portion 24 is formed for each attaching groove 22 so as to extend over the left and right edge portions at the lower portion of the attaching groove 22.

As in FIGS. 8 and 9, it has been described that the wide portion 24 is a recessed portion; however, the present disclosure is not limited thereto. The wide portion 24 may have any shape as long as solder rising and flux rising due to capillary phenomenon can be suppressed, and for example, may be formed as an opening in the rear surface of the insulator 20. Further, the wide portion 24 has been described as being wider in both left and right directions than the groove width of each attaching groove 22; however, the present disclosure is not limited thereto, and the wide portion 24 may be wider in only one of the left and right directions.

The insulator 20 has been described as having a bottom wall 23 between the bottom surfaces of the attaching grooves 22 and the circuit board CB; however, the present disclosure is not limited thereto. The insulator may not have the bottom wall 23, as long as it is possible for the connector 10 to suppress capillary phenomenon by the wide portion 24.

For the connector 10, the wide portion 24 has been described as being formed further in the upward direction than the bottom wall 23; however, the present disclosure is not limited thereto. The wide portion 24 may be formed extending from the attaching grooves 22 to the bottom wall 23, as long as solder rising and flux rising due to capillary phenomenon can be suppressed. That is, in the connector 10, it is unnecessary that the up-down direction position of the bottom surface of the wide portion 24 and that of the bottom surface of each attaching groove 22 are the same. On the contrary, the wide portion 24 may also be formed such that, the up-down direction position of the bottom surface thereof is above that of the bottom surface of each attaching groove 22.

For the connector 10, the upper surface of the wide portion 24 has been described as being located above the arm supporting portions 33; however, the present disclosure is not limited thereto. In the connector 10, the upper surface of the wide portion 24 may be formed at any position, as long as solder rising and flux rising due to capillary phenomenon can be suppressed.

As in FIGS. 8 and 9, the wide portion 24 has been described as having a rectangular shape; however, the present disclosure is not limited thereto. The wide portion 24 may have any shape, as long as solder rising and flux rising due to capillary phenomenon can be suppressed. Further, the wide portion 24 has been described as being formed only at the lower portion of each attaching groove 22; however, the present disclosure is not limited thereto. The wide portion 24 may be widely formed in the up-down direction from the lower portion to the upper portion of each attaching groove 22.

In the connector 10, it has been described that, at least a part of the region R1 in which the base plating P1 is exposed of each contact 30 is located within the up-down direction width of the wide portion 24; however, the present disclosure is not limited thereto. The region R1 may be any region on the surface of each contact 30, as long as solder rising and flux rising can be suppressed. For example, the region R1 may be located further in the downward direction than the wide portion 24 and within the up-down direction width of the bottom wall 23.

REFERENCE SIGNS LIST

10 Connector
20 Insulator
21 Cable insertion groove
22 Attaching groove
23 Bottom wall
24 Wide portion
30 Contact
31 Contact arm
32 Contact protrusion
33 Arm supporting portion
34 Presser arm
35 Supporting recessed portion
36 Tail piece (mounting portion)
37 Engagement protrusion
40 Fixing metal fitting
41 Supporting surface
42 Tail piece
50 Actuator
51 Side arm
52 Arm insertion through-hole
53 Rotation center axis
54 Cam portion
60 FPC (connection object)
61 End portion reinforcing member

62 Circuit pattern
CB Circuit board
R1 Region
P1 Base plating
P2 Surface layer

The invention claimed is:

1. A connector, comprising:

a contact; and an insulator having an attaching groove on an outer surface into which said contact is inserted and attached, wherein said insulator has a bottom wall formed to be continuous with a bottom surface of said attaching groove in a downward direction;

at least a part of said attaching groove has a wide portion wider in at least one direction than a groove width on said outer surface along a direction parallel to said bottom wall;

a part of a surface of said contact is formed by a base plating and a surface layer plating laminated on said base plating; and at least a part of a region in which said surface of said contact is formed by said base plating is located within a width of said wide portion along a direction perpendicular to said bottom wall.

2. The connector according to claim 1, wherein a bottom surface of said wide portion is formed such that a position in said direction perpendicular to said bottom wall is substantially the same as said bottom surface of said attaching groove.

3. The connector according to claim 1, wherein said contact has a mounting portion configured to be connected to a circuit pattern on a circuit board.

4. A connector, comprising:

a contact; and an insulator having an attaching groove on an outer surface into which said contact is inserted and attached, wherein said insulator has a bottom wall formed to be continuous with a bottom surface of said attaching groove in a downward direction;

at least a part of said attaching groove has a wide portion wider in at least one direction than a groove width on said outer surface along a direction parallel to said bottom wall;

said contact has a contact arm that elastically deforms when connected to a connection object; and an arm supporting portion for supporting said contact arm; and an upper surface of said wide portion is located above said arm supporting portion.

* * * * *